United States Patent [19]

Nicol

[11] 3,955,162

[45] May 4, 1976

[54] ELECTROMAGNETIC CIRCUIT BREAKER WITH ELECTRICAL AND MECHANICAL TRIP INDICATION

[75] Inventor: Ronald Nicol, Trenton, N.J.

[73] Assignee: Heinemann Electric Company, Trenton, N.J.

[22] Filed: Nov. 1, 1974

[21] Appl. No.: 519,874

Related U.S. Application Data

[62] Division of Ser. No. 384,702, Aug. 1, 1973, Pat. No. 3,863,042.

[52] U.S. Cl. ..... 335/17; 335/13

[51] Int. Cl.[2] ..... H01H 73/12

[58] Field of Search ..... 335/17, 13; 317/11 C

[56] References Cited

UNITED STATES PATENTS

| | | | |
|---|---|---|---|
| 2,702,358 | 2/1955 | Woodward et al. | 335/13 |
| 2,924,752 | 2/1960 | Scott, Jr. | 317/11 C |
| 3,388,357 | 6/1968 | Lawson et al. | 335/17 |
| 3,742,402 | 6/1973 | Nicol et al. | 335/17 |

*Primary Examiner*—Harold Broome

*Attorney, Agent, or Firm*—Joseph G. Denny, III; Peter J. Patane

[57] ABSTRACT

A circuit breaker having a handle stop for restraining the handle in a "tripped" or central position after the circuit breaker is electrically tripped to mechanically and visually indicate the tripped position.

Also, an actuator is supported within the case of the circuit breaker and pivoted by the linkage mechanism (only when the latter is electrically tripped). During manual opening and closing of the circuit breaker contacts, the linkage mechanism does not pivot the actuator.

Pivoting of the actuator (upon electrical tripping of the linkage mechanism) causes the actuator to engage and activate an auxiliary switch.

When the circuit breaker handle is moved to the "off" position from the tripped or central position, the linkage mechanism simultaneously releases the actuator and the auxiliary switch is deactivated.

7 Claims, 23 Drawing Figures

FIG. 1
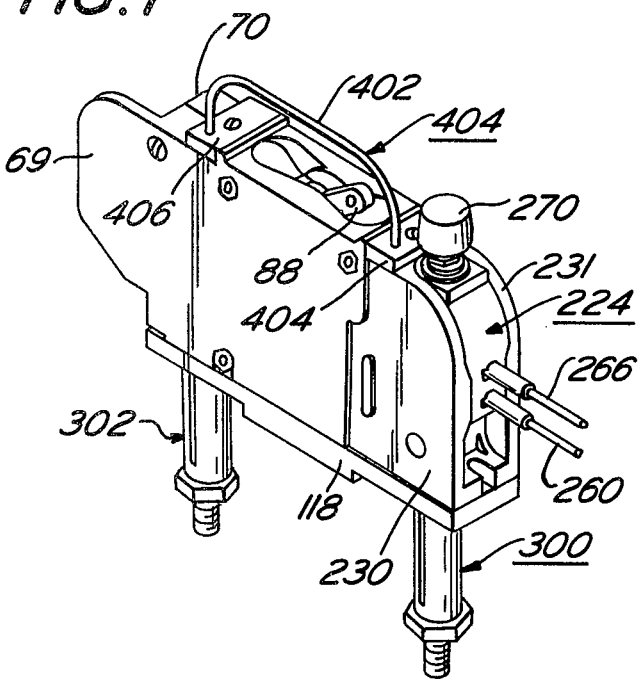
FIG. 10
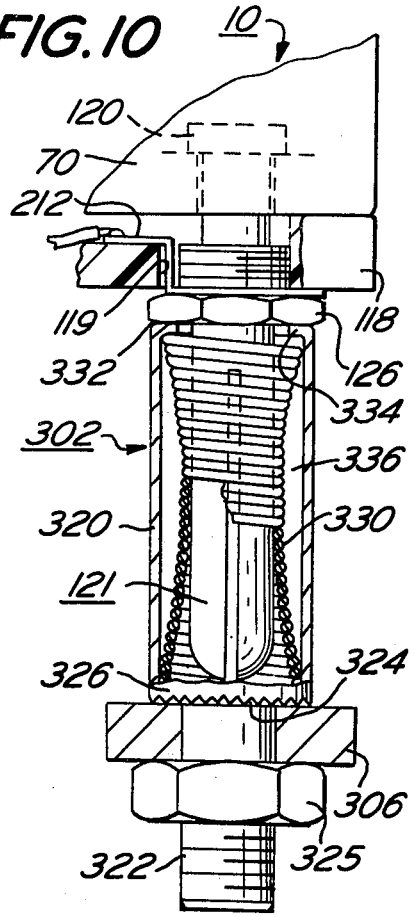
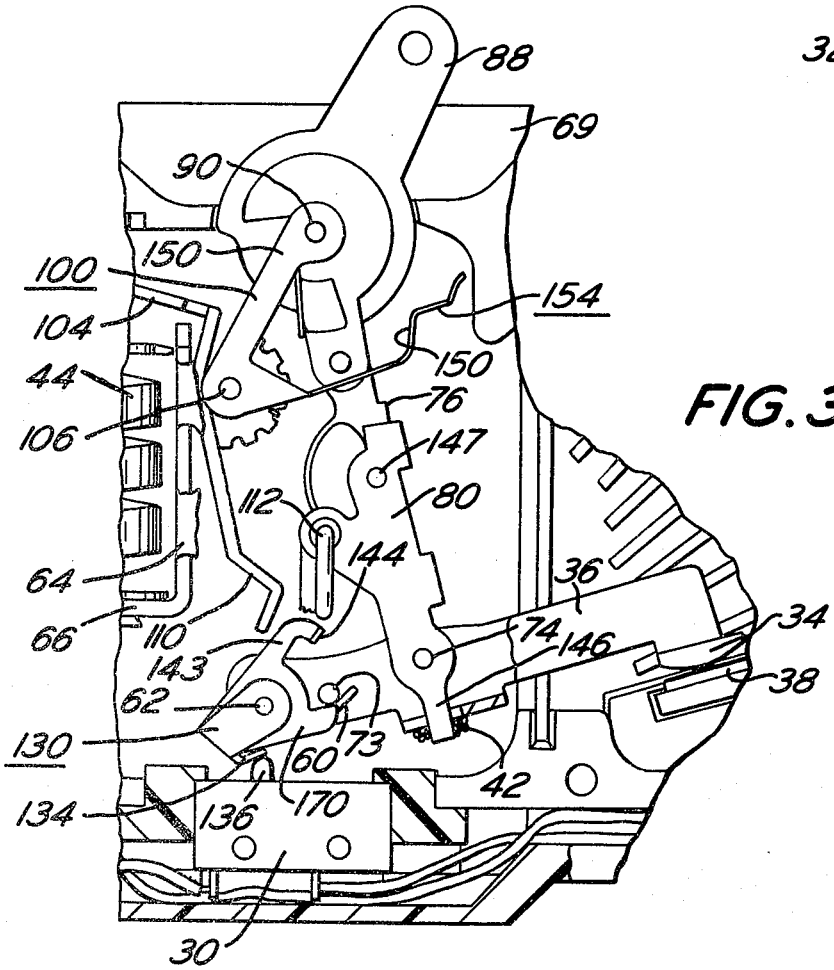
FIG. 3

10
20
69
700
22
40
216
127
121
119
122
126
320
302
306
325
322
38
34
212
200
202
304
116
125
36
146
150
155
88
84
154
86
78
76
147
52
80
74
42
117
141
114
140
112
73
123
30
136
60
144
63
100
68
44
64
92
104
90
82
152
106
66
130
102
108
50
248
205
216
118
204
310
314
56
206
120
54
115
124
300
315
312
244
220
242
236
270
224
234
225
252
246
250
255

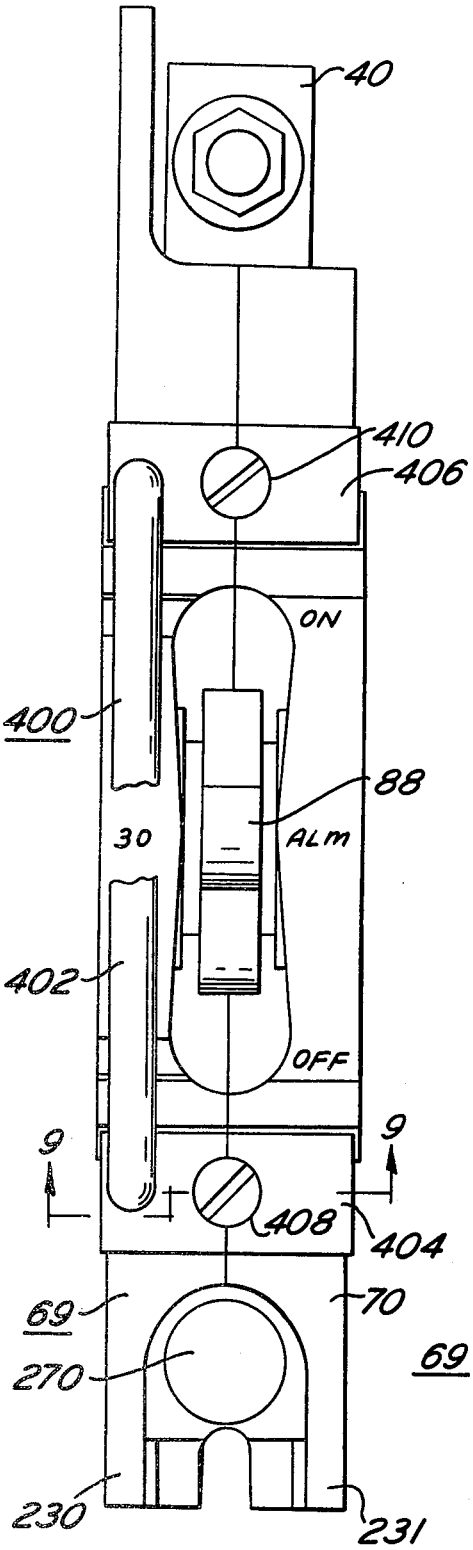
FIG. 8
FIG. 9
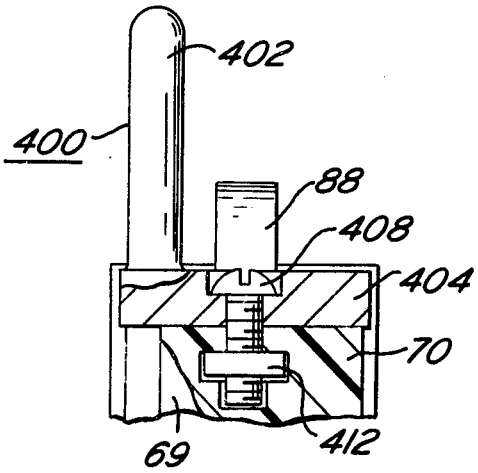
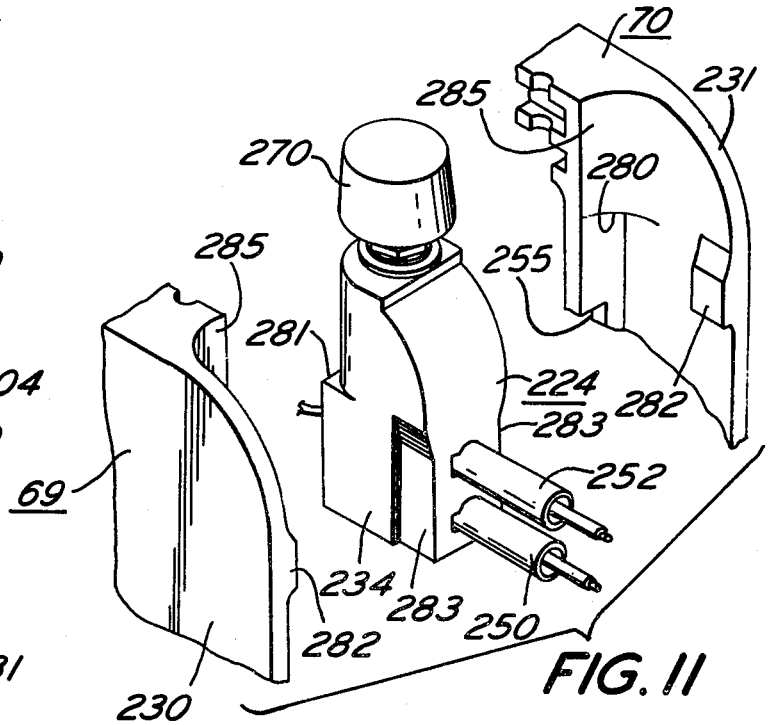
FIG. 11

ELECTROMAGNETIC CIRCUIT BREAKER WITH ELECTRICAL AND MECHANICAL TRIP INDICATION

RELATED APPLICATION

This application is a division of my presently pending U.S. Pat. application, Ser. No. 384,702, filed Aug. 1, 1973 now U.S. Pat. No. 3,863,042.

BACKGROUND OF THE INVENTION

This invention relates generally to electric circuit breakers of the electromagnetic type and more particularly to circuit breakers with arrangements for indicating the electrically tripped "open" condition of the circuit breaker.

Circuit breakers with arrangements for indicating the electrically tripped "open" condition of the circuit breaker contacts are shown in U.S. Pat. Nos. 3,742,402 and 3,742,403, both assigned to the Heinemann Electric Company. Further, a circuit breaker of the electromagnetic type is shown, for example, in Camp U.S. Pat. No. 3,329,913, also assigned to the Heinemann Electric Company.

Such electromagnetic circuit breakers typically comprise a movable contact, mounted on a movable arm, and a stationary contact. An operating handle is coupled to the movable arm via a linkage mechanism, part of the linkage mechanism comprising a collapsible toggle assembly. The movable and stationary contacts are operated between the contacts open and the contacts "closed" positions by pivoting the operating handle. The circuit breaker further comprises an electromagnetic device which in response to predetermined electrical conditions, collapses the toggle assembly, to thereby electrically trip open the contacts.

The circuit breakers shown in U.S. Pat. Nos. 3,742,402 and 3,742,403 incude auxiliary switches which are moved from an initial position, upon electrical tripping of the linkage mechanism, to a second position, upon electrical tripping of the circuit breaker, to indicate (in the second position) the tripped open condition of the circuit breaker contacts. The auxiliary switch remains in this second position until the circuit breaker contacts are manually reclosed at which time the auxiliary switch is reset to its initial position. Thus, to disconnect (or remove) the electrical signal provided by the auxiliary switch, it is necessary to move the circuit breaker handle to its contacts "on" position. However, if a fault current persists in the line, when it is attempted to manually reclose the contacts, it may not be desirable to do so.

BRIEF SUMMARY OF THE INVENTION

It is an object of this invention to provide a circuit breaker which has an auxiliary switch that is moved upon electrical tripping of the contacts and which can thereafter be moved back to its initial position without closing the circuit breaker contacts.

It is a further object of this invention to provide a circuit breaker which will indicate its electrically tripped open condition by movement of the handle to a central position while at the same time also activating an auxiliary switch to provide an electrical signal indicating the tripped open condition of the circuit breaker.

The present invention provides a circuit breaker which electrically indicates whether the circuit breaker has been electrically tripped open by activating an electrical auxiliary switch at such time and, by restraining the handle in a central or tripped position, to simultaneously provide a visual, mechanical indication of the electrically tripped open condition.

The arrangement for electrically indicating the electrically tripped open condition of the circuit breaker contacts comprises an electrical auxiliary switch located within the circuit breaker case and activated by a pivotal actuator. The actuator is pivoted into engagement with the auxiliary switch during the collapse of the circuit breaker linkage mechanism by engagement of the linkage mechanism with the actuator, but not during manual movement of the mechanism between the on and off positions or vice versa.

A stop plate is supported by the frame within the case and includes an abutment against which a portion of the pin connecting the handle link to the remainder of the mechanism initially comes to rest after electrical tripping. When it is desired to deactivate the auxiliary switch, the handle is moved to the off position, at which time the pin depresses the stop plate, permitting passage of the pin and of the handle to their off positions. As the pin and handle move to their off positions, the linkage mechanism is reset, i.e., the linkage mechanism is moved out of engagement with the actuator, freeing the actuator. Once the actuator is freed of the linkage mechanism, the auxiliary switch moves to its initial position and in so doing also moves the actuator to its initial position.

A handle guard is also provided to shield the operating handle and to provide a grasping means for removing the circuit breaker.

A compensating terminal assembly is provided to facilitate insertion of the terminals and compensate for assembly variations.

The foregoing and other objects of the invention, the principles of the invention and the best modes in which I have contemplated applying such principles will more fully appear from the following description and accompanying drawings in illustration thereof.

BRIEF DESCRIPTION OF THE VIEWS

In the drawings:

FIG. 1 is a top and front perspective view of a circuit breaker incorporating this invention;

FIG. 3 is a partial, side elevation similar to that shown in FIG. 2, but the frame has been broken away to better show portions of the linkage mechanism which are hidden in FIG. 2;

FIG. 8 is a top view of the circuit breaker shown in FIG. 1;

FIG. 9 is a partial, sectional view taken along the line 9—9 in FIG. 8;

FIG. 10 is an enlarged, sectional view of the right hand or dummy terminal which is only partially shown in FIG. 2;

FIG. 11 is a partial, exploded view of the two half-cases and the test switch secured therebetween.

Figure 16:
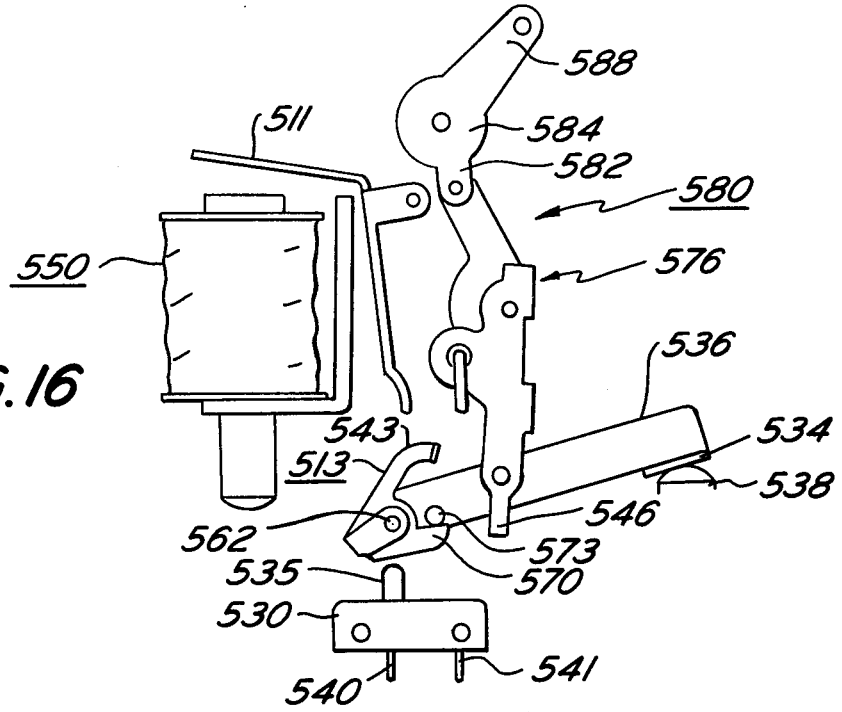
Figure 17:
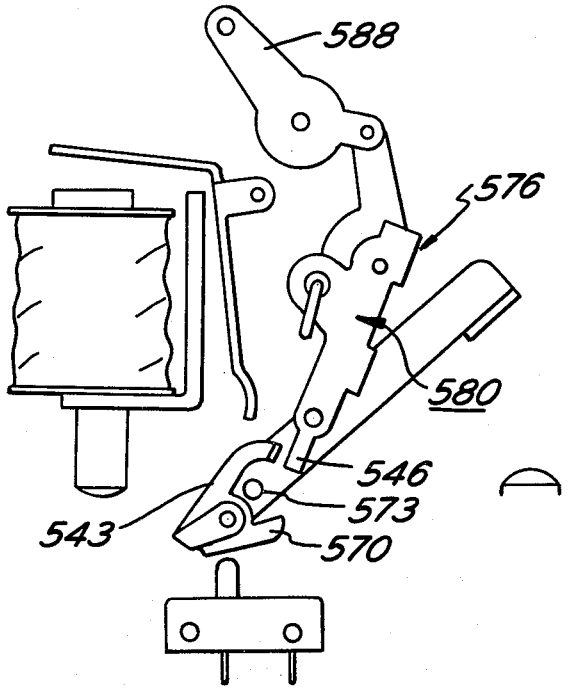
Figure 18:
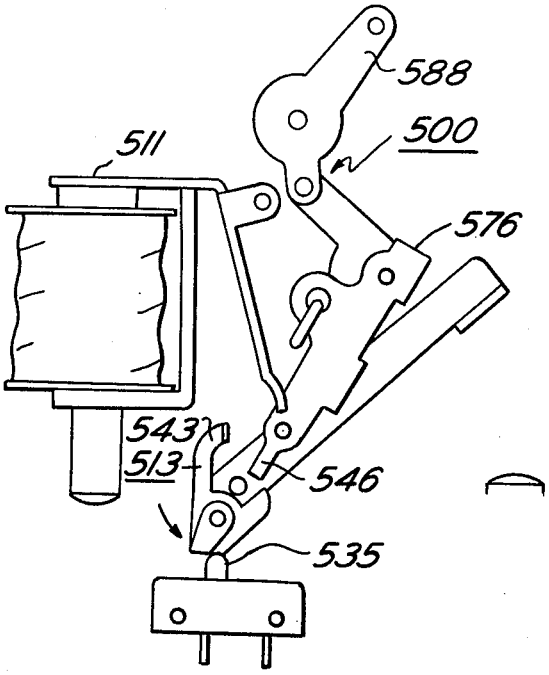
Figure 19:
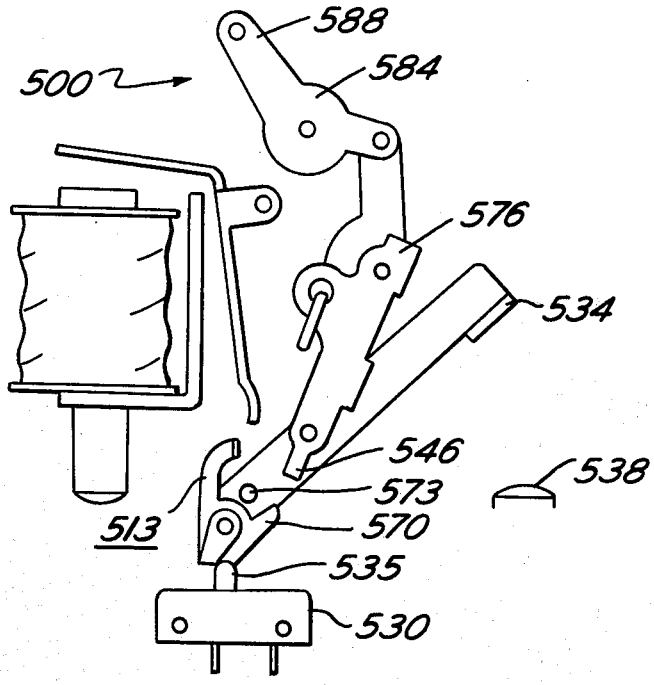
Figure 20:
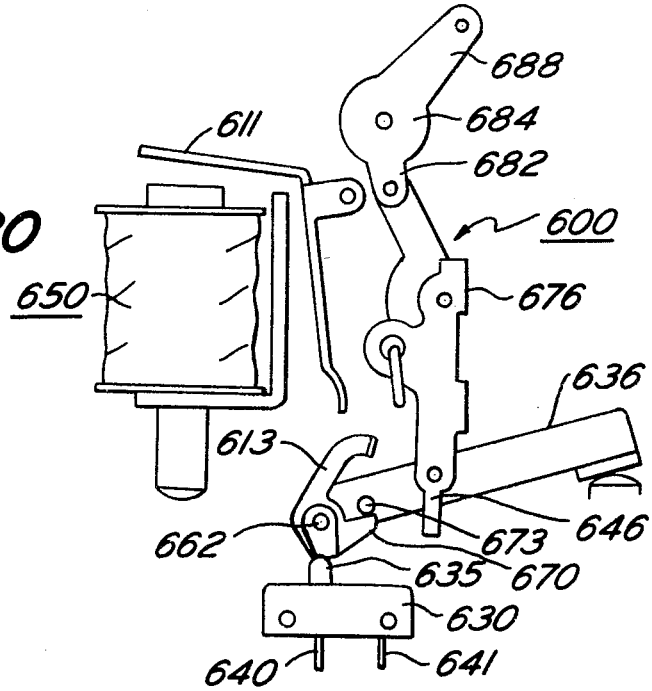
Figure 21:
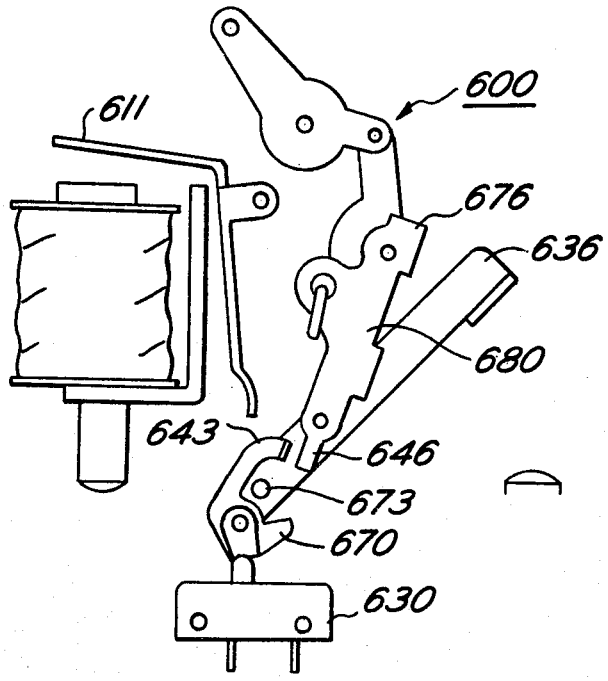
Figure 22:
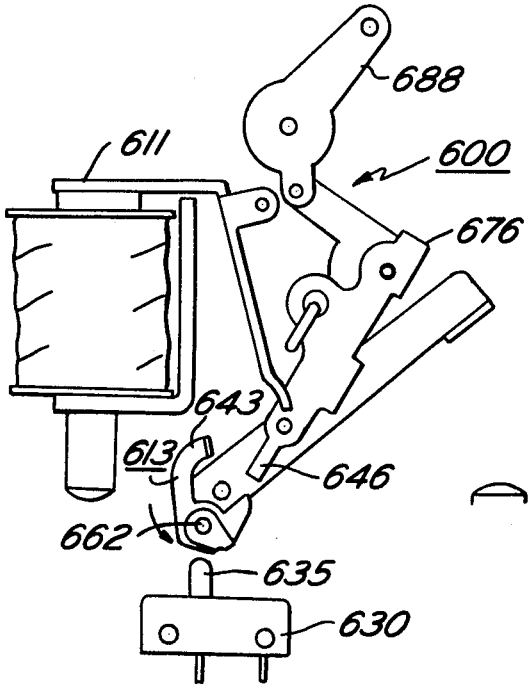
Figure 23:
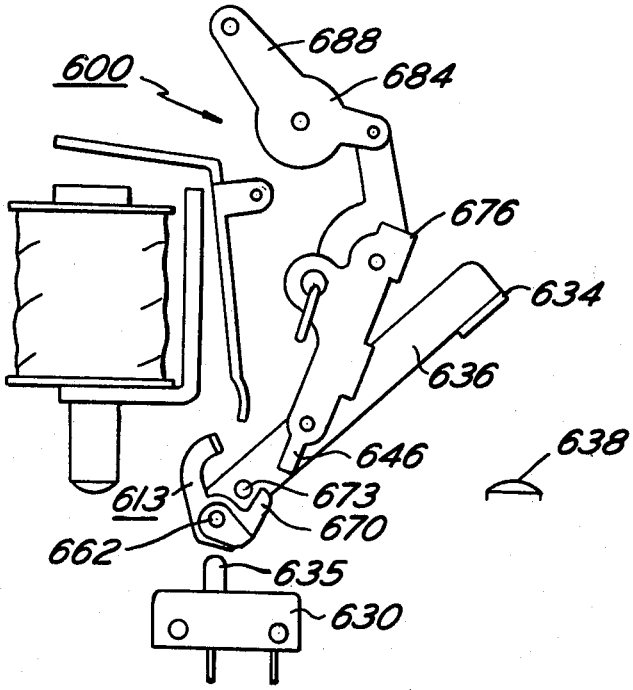

FIGS. 16 through 19 are diagrammatic views and illustrate another embodiment of the actuator to engage the auxiliary switch upon electrical tripping open of the circuit breaker contacts, FIG. 16 showing the closed contacts position, FIG. 17 showing the normally open contacts position, FIG. 18 showing the momentary tripped open contacts position, and FIG. 19 showing the open contacts position following tripping of the circuit breaker; and FIGS. 20 through 23 are diagrammatic views (similar to FIGS. 16 through 19) but illustrate a further embodiment of the actuator to engage the auxiliary switch upon electrical tripping open of the circuit breaker contacts, FIG. 20 showing the closed contacts position, FIG. 21 showing the normally open contacts position, FIG. 22 showing the momentary tripped open contacts position, and FIG. 23 showing the open contacts position following tripping of the circuit breaker.

DESCRIPTION OF THE PREFERRED EMBODIMENTS

Figure 2:
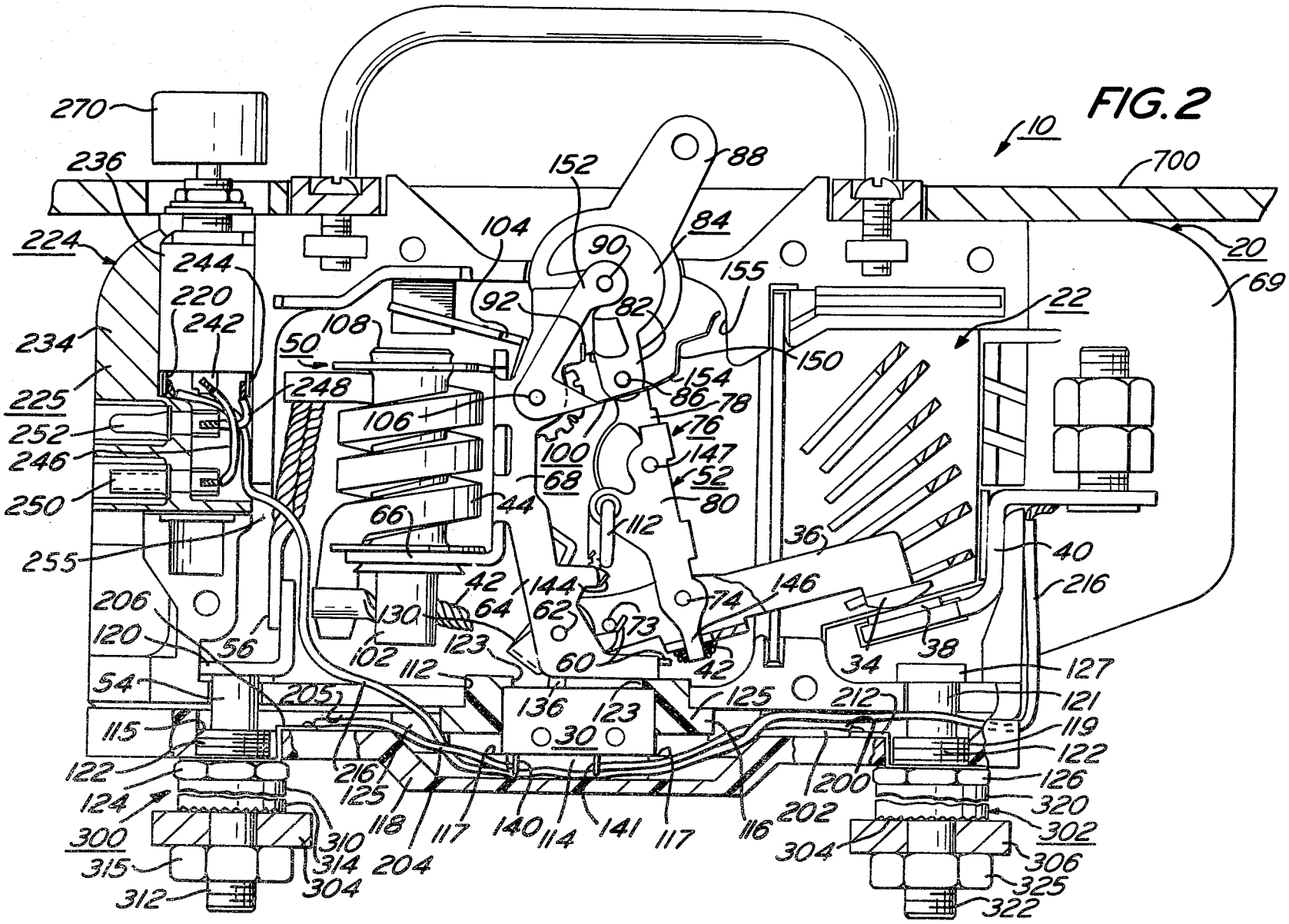
FIG. 2 is an enlarged, side elevation of the circuit breaker shown in FIG. 1 with one of the half-cases removed, the circuit breaker being shown in the contacts closed position.

Referring to the drawings, and in particular to FIGS. 1, 2 and 3, this invention comprises a circuit breaker 10 having a case 20 which houses a circuit breaker assembly 22. An auxiliary switch 30 is supported within the case 20 and located adjacent the circuit breaker assembly 22.

The operation of the circuit breaker assembly 22 is described in detail in U.S. Pat. No. 3,329,913, among others, hence, only a brief description will be given hereafter.

The assembly 22 comprises a movable contact 34 carried by a movable arm 36 and engageable with a stationary contact 38, the latter carried by a terminal 40. The movable arm 36 is connected by a flexible conductor 42 to one end of a coil 44 forming part of an electromagnetic device 50. The electromagnetic device 50, on predetermined electrical conditions, collapses a linkage mechanism 52 to trip open the contacts 34 and 38. The electrical circuit of the circuit breaker is completed by connecting the other end of the coil 44 to the terminal 54 by conductor 56. The collapsible linkage mechanism 52 is of the type that resets, i.e., relatches, automatically after the contacts 34 and 38 are tripped open and the handle 88 is moved to the off position by the handle spring 92, see Camp U.S. Pat. No. 3,329,913 among others.

Further, the movable arm 36 is biased by a spring 60 (FIGS. 2 and 7) toward the open position of the contacts 34 and 38 and is mounted on a pin 62 about which it pivots, the pin 62 being carried by two spaced plates 64 (FIG. 7) which are integral with an L-shaped member 66 and jointly form a frame 68 for carrying the coil 44. The end portions of the pin 62 extend into holes 63 (FIG. 7) formed in the opposed side walls of the half-cases 69 and 70 (FIGS. 1 and 7) to properly locate and support the assembly 22 inside the case 20. Another pin 73, carried by the movable arm 36, has end portions which engage the spaced plates 64 to limit the opening movement of the arm 36 in the position shown in FIG. 2.

Figure 6:
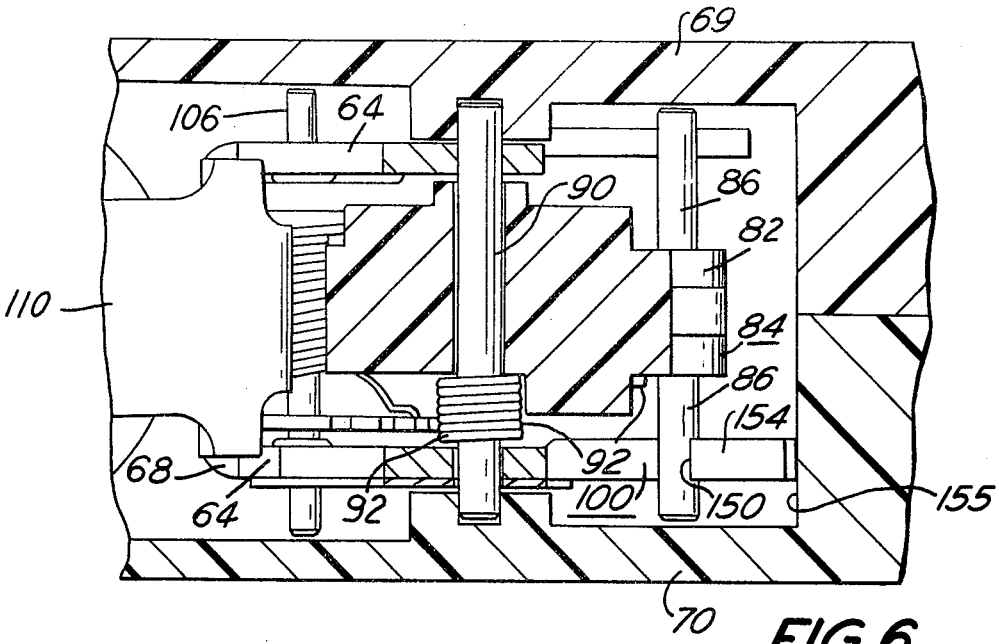
FIG. 6 is a partial, sectional view taken along the line 6—6 in FIG. 4.

The movable arm 36 is also connected by a pin 74 to the linkage mechanism 52 which includes a collapsible toggle assembly 76 having a toggle catch 78 and a U-link 80. The toggle catch 78 is in turn connected to an extension arm 82 of the pivotal handle link 84 by a further pin 86. The handle link 84 is formed with an integral handle 88 and pivots about a pin 90 having its end portions also carried by the spaced plates 64 (FIG. 6). A spring 92 is coiled about the pin 90 and has one end attached to one of the frame plates 64 and the other end of the spring 92 is in contact with the arm 82, the spring being stressed at all times so as to bias the handle link 84 in the counterclockwise direction, FIG. 2, to the contacts open (circuit breaker off) position.

Figure 5:
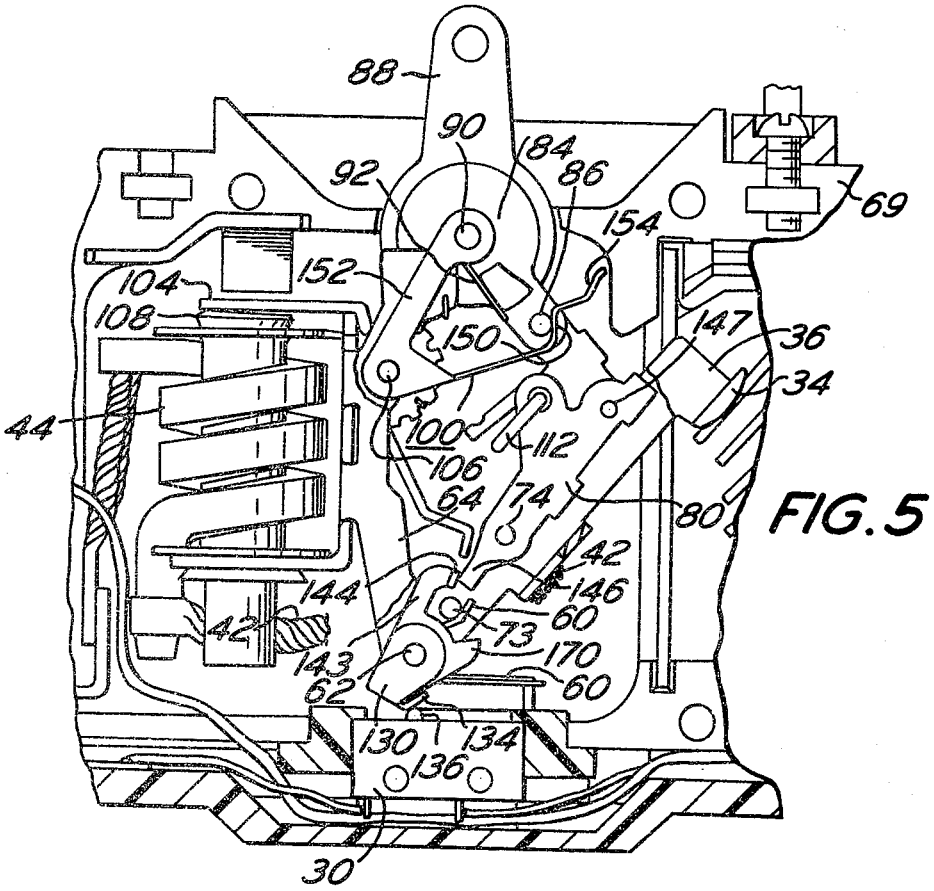
FIG. 5 is a partial, side elevation similar to FIG. 4, but showing the electrically tripped position.

After tripping of the linkage mechanism 52 in response to an overload, for instance, the handle spring 92 automatically moves the handle link 84 from the contacts closed (circuit breaker "on") position of FIG. 2 towards the contacts open (circuit breaker off) position of FIG. 5, but is prevented from doing so by the handle stop 100, resulting in the handle link 84 being restrained in the central position shown in FIG. 5 with the toggle assembly 76 not relatched, as would be the case but for the handle stop 100. When the handle 88 is manually moved past the handle stop 100, the handle spring 92 will move the handle link 84 to the contacts open or off position and automatically relatch the toggle assembly 76.

The frame 68 forms a part of the electromagnetic device 50 to which may be secured a time delay tube 102 housing a spring biased magnetizable core (not shown) movable against the retarding action of a suitable fluid to provide a time delay before tripping of the mechanism on certain overloads.

The operation of this type of linkage mechanism 52 and electromagnetic device 50 is specifically set forth in U.S. Pat. No. 3,329,913 and for purposes of brevity it will only be generally described herein as follows—as the pivotal handle 88 is moved from the contacts open positions to the contacts closed position, the toggle assembly 76 and the movable arm 36 all move down, against the bias of the spring 60, and move the contact 34 into engagement with the stationary contact 38 achieving the contacts closed (circuit breaker on) position, illustrated in FIGS. 2 and 3.

Figure 4:
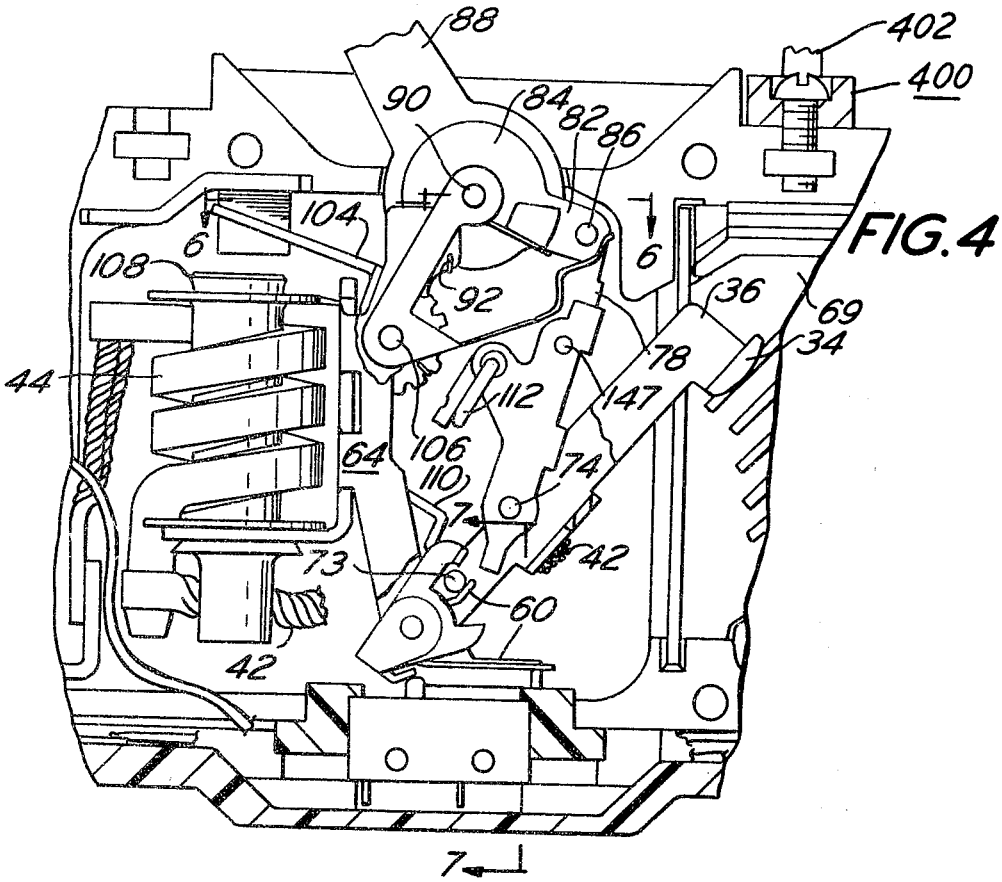
FIG. 4 is a partial, side elevation similar to FIG. 3, but showing the contacts open position.

The electromagnetic device 50 includes an armature 104 which is pivoted on a pin 106 whose end portions are also carried by suitable holes in the frame plates 64. Upon the occurence of a predetermined overload condition, assuming the circuit breaker to be in the contacts closed position, the armature 104 is attracted toward the pole piece 108, either after a time delay period or virtually instantaneously, depending on the overload condition. The movement of the armature 104, toward the pole piece 108 causes the oppositely extending trip finger 110, which is integral with the armature 104, to pivot to the right as seen in FIGS. 2 and 4 and engage and trip the arm 112 forming part of the linkage mechanism 52, whereupon the toggle assembly 76 collapses and the movable arm 36 moves upward under the bias of the spring 60 to open the contacts 34 and 38. The collapsing motion of the toggle assembly 76 is independent of the position of the handle link 84 and the handle 88. The handle link 84 is then moved toward the contacts open position, under the pressure applied by the spring 92, but is prevented from completely doing so by the handle stop 100.

The two approximate half-cases 69 and 70 form a main cavity for housing the circuit breaker assembly 22. The two half-cases 69 and 70 include opposed openings 112 communicating with an opening 114 formed in a base plate 118. The base plate 118 supports the auxiliary switch 30 upon abutments 117. The auxiliary switch 30 is prevented from moving upward, as viewed in FIG. 2, by a spacer 116 which has over-hanging shoulders 123 and feet 125 trapped between the half-cases 69 and 70 and the abutments 117. The bottom plate 118, the spacer 116, and the half-cases 69 and 70 are formed of suitable electrical insulating materials.

The base plate 118 is secured to the half-cases 69 and 70 by the previously mentioned terminal 54 and a dummy terminal 121 the terminals 54 and 121 extending through suitable holes 115 and 119 in the base plate 118. Each of the terminals 54 and 121 include plates 120 and 127, respectively, which extend into openings (not shown) in the opposed half-cases 69 and 70. Each of the terminals 54 and 121 also include threaded portions 122 on which are threaded nuts 124 and 126 to bias the base plate 118 against the bottom surfaces of the half-cases 69 and 70.

Figure 7:
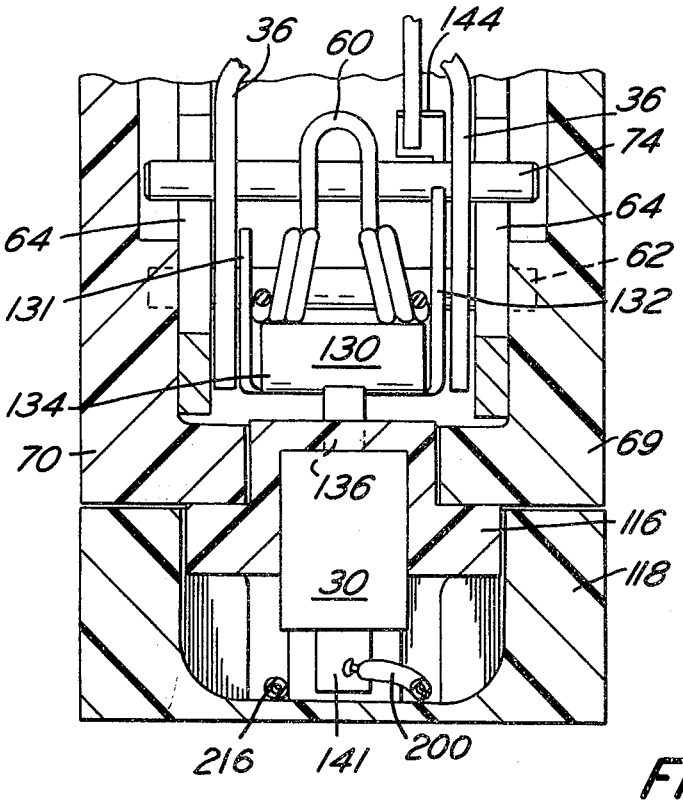
FIG. 7 is a partial, sectional view taken along the line 7—7 in FIG. 4.

Nested between the two spaced legs of the movable arm 36, as shown in FIG. 7, is an actuator 130 pivotally carried by the pin 62. The actuator 130 comprises arms 131 and 132 having aligned holes through which passes the pin 62. The arms 131 and 132 are bridged by an integral heel 134 which is engageable with the upwardly biased button 136 of switch 30. The switch 30 is a unitary member having its own insulating case and the internal arrangement of the switch 30 is such that the internal contacts (not shown) are normally open and the button 136 is biased upwardly, keeping the circuit between terminals 140 and 141 normally open.

The arm 132 of the actuator 130 includes a finger 143 extending upwardly, as shown, having a flag portion 144 turned at approximately a right angle to the plane of the finger 143. Upon collapse of the toggle assembly 76, and the opening of the circuit breaker contacts 34 and 38, a downwardly extending extension 146 on one arm of the U-link 80 forcefully engages and pivots the actuator 130 from the positions shown in FIGS. 2 and 3 to the position shown in FIG. 5. In so pivoting the actuator 130, the heel 134 thereof engages and depresses the button 136, closing the internal contacts of the switch 30, the force transmitted to the actuator 130 by the collapsing toggle assembly 76 being substantially greater than the upward force or bias on the button 136 exerted by the internal linkage of the switch 30.

As the toggle assembly 76 collapses, the handle spring 92 pivots the handle link 84 toward the contacts open or off position. However, the handle link 84 moves only to the central position shown in FIG. 5 and is restrained in this position by the abutment of an end portion of the pin 86 with a detent cam section 150 of the handle stop 100. The cam section 150 extends upwardly and to the left and slightly overhangs the pin 86, as shown in FIG. 5. The pin 86 stops approximately in a straight line between the center of the handle pin 90 and the pin 147 between the toggle catch 78 and the U-link 80, as shown in FIG. 5.

The handle stop 100 comprises a plate 152 carried by the ends of the pins 90 and 106 shown in FIG. 2, for example, and lies against one of the frame plates 64, as shown in FIG. 6, and between this frame plate 64 and the half-case 70. The handle stop 100 further includes a spring or leaf portion 154 (of which the detent cam 150 is a part), the leaf portion 154 being bent at approximately a right angle from the plate 152 and back therefrom (relative to the plane shown in FIG. 5).

Since the leaf portion 154 is relatively flexible, when the pin 86 engages the vertical section 150 it bends the leaf portion 154 downwardly, as viewed in FIG. 5, or to the right, as viewed in FIG. 6, into abutment with the adjacent wall 155 of the half-case 70, the wall 155 being shown in FIG. 6.

Thus, when the circuit breaker is electrically tripped open the handle 88 and the actuator 130 are pivoted to the positions shown in FIGS. 5 and 6, the handle 88 providing a visual indication and the auxiliary switch 30 closing the contacts (not shown) of a circuit which provides the tripping open of the contacts 34 and 38.

If it is desired to open the contacts (not shown) of the auxiliary switch 30, after the tripped position of FIGS. 5 and 6 has been achieved, the handle 88 is manually pivoted counterclockwise from the position of FIG. 5 to the off position shown in FIG. 4. In so doing, the pin 86 depresses the leaf 154 and the pin 86 rides up on the detent cam 150 (which at this time tends to bend down and out of the path of pin 86) and the pin 86 frees itself of the cam surface 150 by moving up away from the leaf 156. (As the pin 86 moves away from the leaf 154, the leaf 154 springs away from the wall 155.) Further, as the pin moves up away from the leaf 154, the catch link 78 rotates clockwise (FIGS. 4 and 5) and in so doing relatches the toggle assembly 76, and carries the link extension 146 away from the flag 144, releasing the actuator 130. Since the button 136 is biased upward against the heel 134, and since the heel slopes, as shown in FIG. 5, a component of the biasing force on the button 136 now pivots the actuator 130 clockwise, about the pin 62, resetting the actuator to its initial position of FIG. 3.

During manual opening and closing of the contacts 34 and 38, by pivoting of the handle back and forth between the positions of FIGS. 2 and 4, the link extension 146 is at all times clear or free of the actuator 130 and, hence, the button 136 of switch 134 is not depressed at such time.

Figure 15:
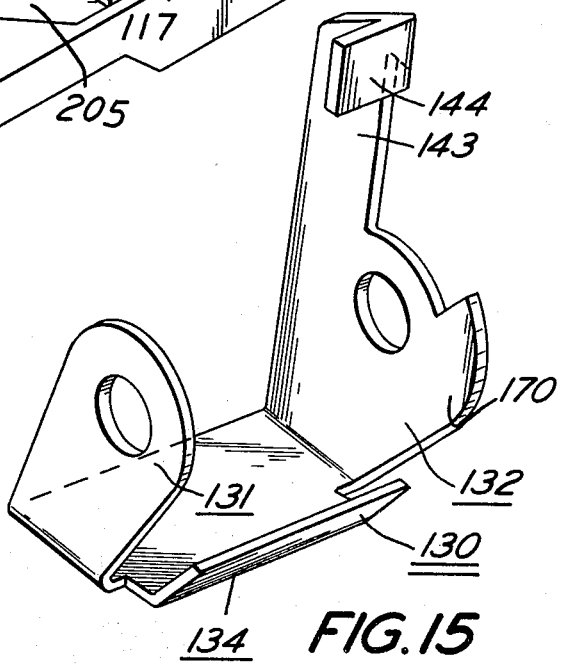
FIG. 15 is a top perspective view of the actuator.

Likewise, the pin 73 which is carried by the movable arm 36 and which limits counterclockwise movement of the movable arm 36 by abutment with the frame plates 64, (FIGS. 2 and 5) is spaced from the actuator 130 and does not engage the actuator 130, as the pin 73 moves back and forth between the positions of FIGS. 2 and 4 during manual opening and closing of the contacts 34 and 38. The movement of the pin 73 at such time is in the generally U-shaped space between the upstanding fingers 143 and 170, the upstanding fingers being best illustrated in FIG. 15.

However, if the upward spring bias on the button 136 should fail, when the handle 88 is pivoted to the off position, and, hence, the actuator 130 not be automatically reset to its initial position of FIG. 4, the contacts (not shown) of the auxiliary switch 30 would erroneously continue to indicate the electrically tripped open condition. At such time, if the handle 88 were moved to the contacts closed position of FIGS. 2 and 3, i.e., the movable arm 36 being pivoted down, the pin 73 would now engage the finger 170 and pivot the actuator 130 clockwise to its initial position, i.e., the position shown in FIGS. 2, 3 and 4, at which time the contacts of the auxiliary switch 30 would open and the electrically tripped open position would no longer be shown (or sounded if an audible alarm is used) by the trip circuit, shown diagramatically in FIG. 3, connected to the auxiliary switch.

On the other hand, if the contacts of the auxiliary switch 30 should for some reason snap open and impart on the button 136 an excessive upward force, the actuator 130 might rotate clockwise excessively. To prevent such excessive clockwise rotation the finger 143 will abut the pin 73 and stop the actuator in the position shown in FIG. 4.

The terminal 141 of the auxiliary switch 30 is connected to a clip 212 by an insulated electrical lead 200 extending through a groove 202 in the base plate 118. The other terminal 140 is similarly connected by an insulated electrical lead 204 extending through a groove 205 and to a clip 206. The clip 206 extends from the groove 205 (in the base plate 118) through the hole 115 for the terminal 54 in the base plate 118 and below the base plate 118. The portion of the clip 206 below the base plate 118 is held captive to the base plate 118 by the nut 124, as shown. Likewise, the clip 212 extends from the groove 202 (in the base plate 118) through the hole 119 for the dummy terminal 121 in the base plate 118 and below the base plate 118. The portion of the clip 212 below the base plate 118 is held captive to the base plate by the nut 126.

Figure 14:
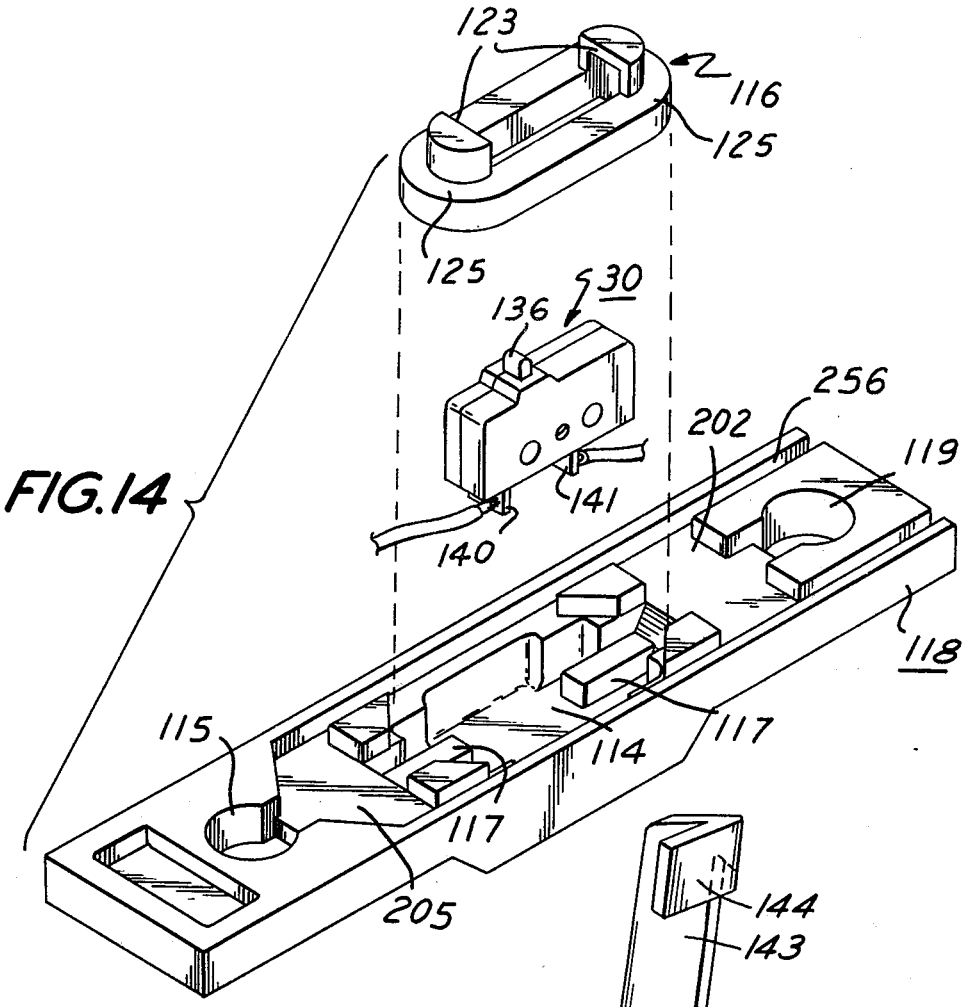
FIG. 14 is a top perspective, exploded view of the auxiliary switch, the spacer and the base plate.

The circuit breaker 10 also carries a momentary push-push switch device 224 for use in testing (or otherwise operating) the load protected by the circuit breaker 10. The switch device 224 includes a terminal 220 to which is connected an insulated electrical lead 216 which extends through the cavity of the circuit breaker 10 from a hole 255 in the left hand end wall (FIGS. 2 and 11), formed by the two half-cases 69 and 70. The lead 216 also extends through a groove 256 in the base plate 118, shown in FIG. 14, and is connected to the load terminal 40, as shown in FIG. 2.

The switch device 224 is held captive between opposed end walls 230 and 231, respectively, of the half-cases 69 and 70, as shown in FIG. 11. The switch device 224, as shown in FIG. 2, comprises a housing 234 carrying a momentary push-push switch module 236 secured by a threaded stem and nut arrangement extending through an opening at the top of the housing 234. The back of the housing 234 is open to facilitate access thereto.

The switch module 236, FIG. 2, further includes terminals 242 and 244 to which are secured further leads 246 and 248, respectively. The leads 246 and 248 are in turn connected to further terminals 250 and 252 by which the switch module 236 may be connected to an external circuit, as shown diagrammatically in FIG. 13. The terminals 250 and 252 are carried by and extend through the switch housing 234 (between the end walls 230 and 231 of the half-cases 69 and 70).

Figure 13:
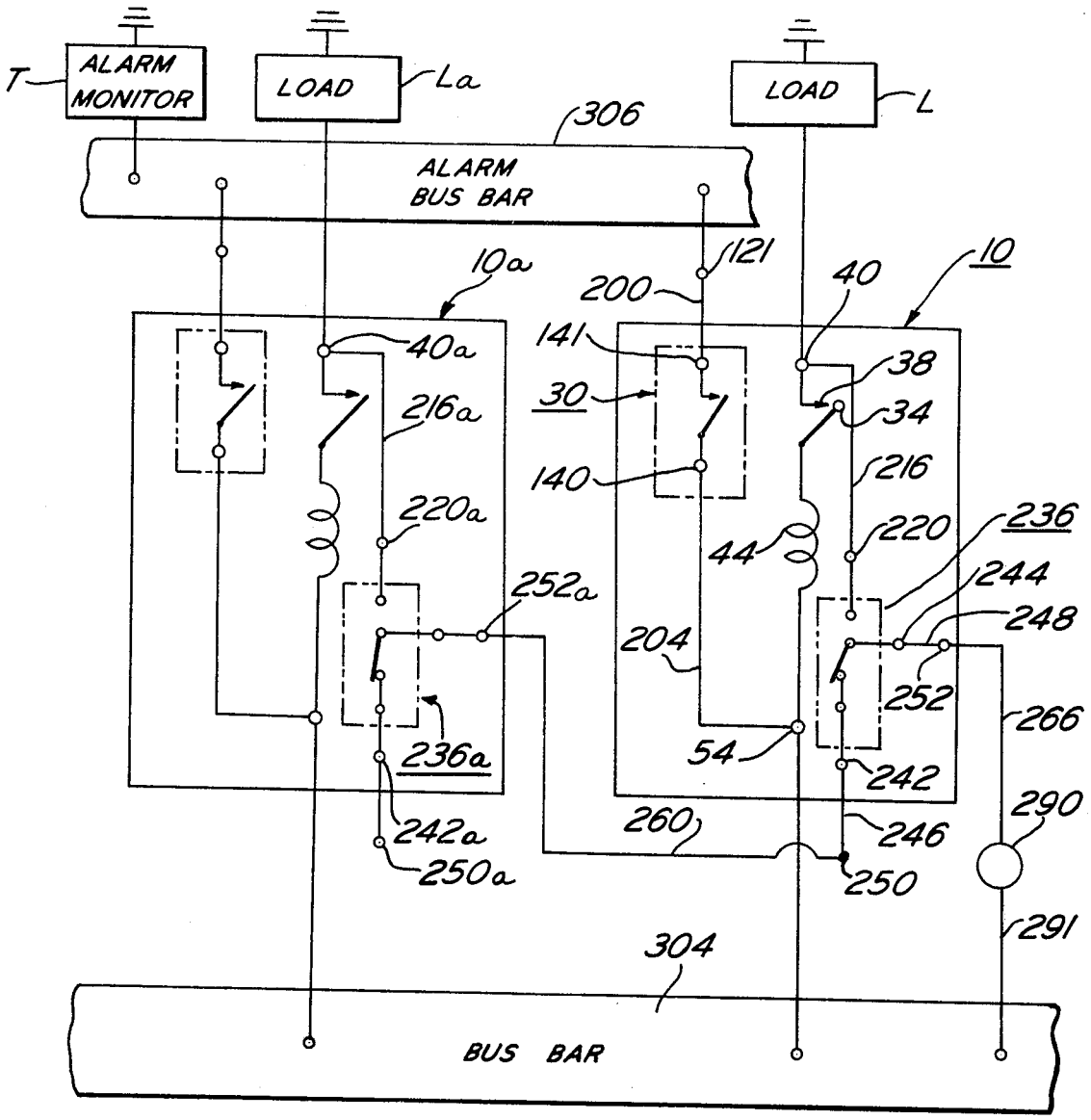
FIG. 13 is a schematic, electrical diagram of the test circuit.
Figure 12:
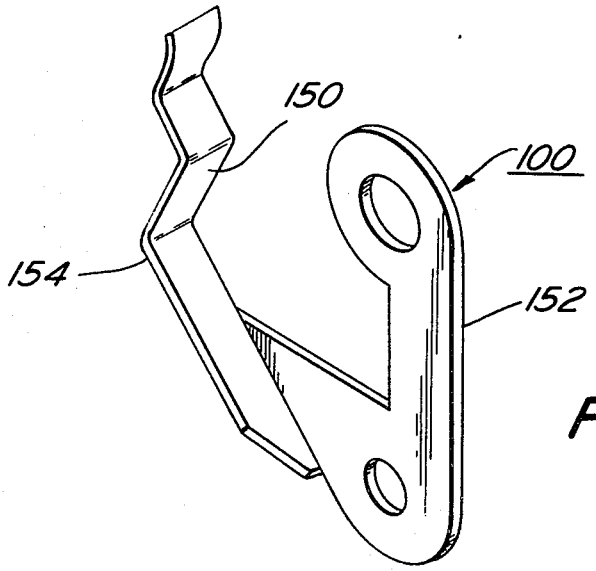
FIG. 12 is a perspective view of the stop plate.

FIG. 13 futher illustrates diagrammatically the circuit breaker 10 and an adjacent circuit breaker 10*a*.

The switch modules 236 and 236*a* of the two circuit breakers 10 and 10*a* are interconnected as shown. Switch module 236 is connected at terminal 252 by wire 266 to a lamp 290 and by another wire 291 to bus 304. Electrical lead wire 260 connects terminal 250 to terminal 252*a*. The terminal 250*a* is plugged. (If a third circuit breaker, not illustrated, is to be connected to the series, terminal 250*a* would be connected to a terminal [of the third breaker] corresponding to the terminal 252*a*, by a suitable wire.)

The test switches 236 and 236*a* are single pole, double throw switches. The contacts 250 and 252 are closed in switch 236 and the contacts 250*a* and 252*b* are closed in switch 236*a*.

The terminal 220 of the switch module 236 is connected by lead 216 to the load terminal 40, and the circuit breaker 10*a* has a lead 216*a* which connects the terminal 220*a* to the load terminal 40*a*.

Loads L and La are connected by suitable conductors to the load terminals 40 and 40*a*. In one embodiment, the loads L and La are capacitive loads and the switches 236 and 236*a* provide a method to charge the loads when the circuit breaker contacts are open, by keeping depressed the button of the appropriate switch module 236 or 236*a* for the time required.

Thus, it is seen that when the switch 236 is momentarily actuated and the circuit is closed between the terminals 220 and 244, the terminals 220 and 244 are then in parallel with the circuit breaker contacts 34 and 38 and coil 44, as shown, and all are in series with the load L, but it is normally intended that the switch 236 will be actuated (and the circuit between terminals 220 and 244 be closed) only when the circuit breaker contacts are open.

FIG. 2 illustrates only the button 270 of switch module 236 and when it is depressed the circuit between terminals 250 and 252 is opened and the circuit between terminals 220 and 252 is closed. Thus, depressing the button of any one of the switches 236 or 236*a* will open the circuit to the succeeding switches and close the circuit of the circuit breaker whose button is depressed.

Lamp 290 is provided to show that the test circuit is closed and to limit the current in the circuit through switch modules.

While two circuit breakers 10 and 10*a* have been diagrammatically illustrated in FIG. 13, it will be understood that any number of circuit breakers may be interconnected in the manner illustrated and described.

Preferably the terminals 250 is a female terminal and terminal 252 a male terminal to assure correct electrical connections.

Referring to FIG. 11 it is seen that the case 234 is interfitted with and is captured between the opposed walls 230 and 231. The walls 230 and 231 have abutments 280 overlying corresponding shoulders 281 to prevent upward movement of the case 234. Further, the walls 230 and 231 include projections 282 nesting in recesses 283 to restrain downward and outward (to the right in FIG. 11) movement of the case 234. The case 234 is, of course, restrained from inward (to the left in FIG. 11) movement by the wrap-around portions 285 of the walls 230 and 231.

As indicated in FIGS. 2 and 10, the terminals 54 and 121 are inserted into and carried by bus terminals 300 and 302. The bus terminals 300 and 302 are in turn carried by bus bars 304 and 306, respectively.

The bus terminal 300 comprises a cylindrical sleeve 310 (having a longitudinal slot) and an integral threaded stud 312 of reduced diameter relative to the sleeve 310 so as to define a face 314 (having a knurled edge) abutting the upper surface of the bus bar 304. The threaded stud 312 extends through a suitable hole in the bus bar 304 and is retained thereto by a nut 315.

Similarly, the bus terminal 302, FIG. 10, comprises a cylindrical sleeve 320 and an integral threaded stud 322 of reduced diameter relative to the sleeve 320 so as to define a face 324 (having a knurled edge) abutting the upper surface of the bus bar 306. The threaded stud 322 extends through a suitable hole in the bus bar 306 and is retained thereto by a nut 325.

The sleeve 320 is of tubular shape having an open, upper end and a lower end closed by end wall 326. Seated upon the wall 326, centrally within the sleeve 320 is spring 330. The spring 330 is preferably closely coiled, and the spring coil diameter progressively decreases along the length of the spring, so as to have its smallest diameter at the midportion thereof and its largest diameter on both ends of the spring, as illustrated. The largest diameter of the spring (at its ends) is approximately that of the inside diameter of the sleeve 320.

The spring 330 is retained within the sleeve by bending over the upper portion or lip 332 of the sleeve so as to compress the spring 330 against the end wall 326, as shown.

The smallest diameter of the spring 330, on its inside, is slightly less than the outside diameter of the dummy terminal 121, to frictionally receive the dummy terminal 121. However, the opening 334 into the sleeve and the annular gap 336 between the spring 330 and the inside wall of the sleeve are sufficiently large to permit the central or midportion of the spring 330 to distort to one side or another, as the dummy terminal 121 enters the spring 330, if the terminal 121 is not centrally aligned with the longitudinal axis of the bus terminal 302. (While not illustrated in detail, the terminal 54 has a lower portion, similar to the lower portion of the terminal 121, as shown in FIG. 10, which is frictionally received in the bus terminal 300.)

Normally the bus terminals 300 and 302 are fixed to the bus bars 304 and 306 and thereafter the circuit breaker terminals 51 and 121 are inserted into the bus terminals 300 and 302. The lateral flexibility of the spring 330 together with the annular gap 336 into which it may move, tends to accommodate a certain amount of deviation between the center-to-center distance of the circuit breaker terminals 51 and 121 vis-a-vis the bus terminals 304 and 306.

Referring to FIGS. 1, 8 and 9 in particular, the circuit breaker 10 includes a handle grip and guard 400. The handle grip 400 comprises an inverted U-shaped guard handle 402 secured at its ends to lugs 404 and 406. The lugs 404 and 406 are placed upon the upper surface of the half-cases 69 and 70, as shown in FIG. 9, on opposite sides of the handle 88. The grip handle 402 is preferably placed to one side of the longitudinal axis of the circuit breaker 10, as illustrated, and provides a convenient arrangement for pulling the circuit breaker 10 from the bus terminals 300 and 302 while tending to guard the handle 88 from accidental movement.

The lugs 404 and 406 are provided with suitable holes through which extend screws 408 and 410. The screws 408 and 410 extend between the half-cases 69 and 70, as shown, and into threaded nuts 412, FIGS. 2 and 9. The nuts 412 are captive in suitable slots formed in the abutting walls of the half-cases 69 and 70.

FIG. 13 also shows the schematic, electrical diagram of the alarm or auxiliary circuit. It is seen that the alarm or auxiliary switch 30 has internal contacts which are normally open, i.e., its contacts are open when the button 136 is raised or is in its upward position, as shown in FIGS. 3 and 4.

Further, even though the auxiliary switch terminal 140 is connected by lead 204 to the circuit breaker terminal 54 (which is, of course, electrically energized when the circuit breaker contacts 34 and 38 are closed) the circuit to the trip alarm T is open at such time and no signal is given nor any alarm sounded.

However, upon electrical tripping of the circuit breaker contacts 34 and 38, the actuator 130 rotates counterclockwise, as viewed in FIG. 5, and depresses the button 136, closing the internal contacts of the auxiliary switch 30, whereupon current flows from the terminal 54, through the lead 204, the terminal 140, the internal contacts of the auxiliary switch 30, the terminal 141, the lead 200, the terminal 121, the bus bar 306, and to the alarm device T, and thereafter to ground, as shown in FIG. 13.

Referring to FIGS. 16 through 19, another embodiment of this invention is illustrated. In FIGS. 16 through 19, only the portions of a circuit breaker 500 which are essential to the understanding of this embodiment are illustrated, the illustrations being primarily diagrammatic sketches of the parts involved.

The circuit breaker 500 comprises a handle 588 forming part of a handle link 584 having an arm 582. The arm 582 is connected to the automatically resettable toggle assembly 576. The toggle assembly 576 is pivotally connected to the movable arm 536.

An electromagnetic device 550 including a pivotal armature 511 is provided to trip the toggle assembly 576 on predetermined overloads.

The circuit breaker 500 also includes an actuator 513. The movable arm 536 and the actuator 513 are pivotally mounted on a pin 562 carried by a frame (not shown), but similar to the frame 64 of the previous embodiment.

Further, the circuit breaker 500 includes an auxiliary switch 530. The auxiliary switch 530 has internal contacts connected to the terminals 540 and 541, the internal contacts being normally open, i.e., being open when the button 535 is in its raised position, the position shown in FIG. 16. Preferably the button 535 reciprocates along a vertical line which passes through the center of the pin 562. As shown in FIG. 16, a pin 573 engages a finger 570 of the actuator 513 restricting counterclockwise movement thereof.

When the handle 588 is turned counterclockwise, to the "off" or contacts open position shown in FIG. 17, the toggle assembly 576 and the movable arm 536 all move from the position shown in FIG. 16 to that shown in FIG. 17. At this time, the pin 573 moves counterclockwise away from the finger 570 toward the finger 543, but does not engage the latter. Note also that at this time the extension 546 of the U-link 580 moves toward the finger 543, but also does not engage the latter.

Assuming the circuit breaker 500 to be in the contacts closed or on position, the position shown in FIG. 16, upon the occurrence of predetermined electrical conditions, the armature 511 is pivoted to the position shown in FIG. 18, and the toggle assembly 576 unlatches, whereupon the toggle assembly 576 collapses to the momentary position shown in FIG. 18. As such time the extension 546 forcefully engages the finger 543 and causes the actuator 513 to pivot counterclockwise into engagement with the button 535, depressing the latter to the position shown in FIG. 18 with the button 535 entering a recess or detent formed in the lower surface of the actuator 513, as shown.

When the button 535 is depressed to the position shown in FIG. 18, the internal contacts of the auxiliary switch 530 are closed. The actuator 513 remains in the position shown in FIG. 18, but the toggle assembly 576 and the handle 588 pivot to the position shown in FIG. 19, i.e., the toggle assembly 576 relatches automatically and the handle link 584 moves to the off or contacts open position.

In the position of FIG. 19, the internal contacts of the auxiliary switch 530 are closed, so that the circuit to the trip alarm (not shown) or other device connected to the terminals of the auxiliary switch is energized. To deenergize the trip alarm, i.e., to open the internal contacts of the auxiliary switch, the handle 588 is rotated to the contacts closed position, the position shown in FIG. 16. In so doing, the pin 573 engages the finger 570 and rotates the latter clockwise, lifting the actuator 513 off of the button 535 which is then free to move upwardly (under its internal bias) to the position shown in FIG. 16, opening the internal contacts of the auxiliary switch and, thereby, opening the alarm circuit. To effect the opening of the auxiliary switch contacts it is only necessary to move the movable arm 536 so that its movable contact 534 makes only momentary (or almost makes) contact with the stationary contact 538. Under some conditions or with some loads, it is permissible to so momentarily close the circuit breaker contacts, but if not, then the embodiment of FIGS. 1 through 15 is preferred.

Referring to FIGS. 20 through 21, a further embodiment of this invention is illustrated. In FIGS. 20 through 21, only the portions of a circuit breaker 600 which are essential to the understanding of this embodiment are illustrated, the illustrations being primarily diagrammatic sketches of the parts involved.

The circuit breaker 600 comprises a handle 688 forming part of a handle link 684 having an arm 682. The arm 682 is connected to the automatically resettable toggle assembly 676. The toggle assembly 676 is pivotally connected to the movable arm 636.

An electromagnetic device 650 including a pivotal armature 611 is provided to trip the toggle assembly 676 on predetermined overloads.

The circuit breaker 600 also includes an actuator 613. The movable arm 636 and the actuator 613 are pivotally mounted on a pin 662 carried by a frame (not shown), but similar to the frame 64 of the first embodiment.

Further, the circuit breaker 600 includes an auxiliary switch 630. The auxiliary switch 630 has internal contacts connected to the terminals 640 and 641, the internal contacts being normally closed, i.e., being closed when the button 635 is in its raised position, the position shown in FIGS. 22 and 23. Preferably the button 635 reciprocates along a vertical line which passes through the center of the pin 662. As shown in FIG. 20, a pin 673 engages a finger 670 of the actuator 613 restricting counterclockwise movement thereof.

When the handle 688 is turned counterclockwise, to the "off" or contacts open position shown in FIG. 21, the toggle assembly 676 and the movable arm 636 all move from the position shown in FIG. 20 to that shown in FIG. 21. At this time, the pin 673 moves counterclockwise away from the finger 670 toward the finger 643, but does not engage the latter. Note also that at this time the extension 646 of the U-link 680 moves toward the finger 643, but also does not engage the latter.

Assuming the circuit breaker 600 to be in the contacts closed or on position, the position shown in FIG. 20, upon the occurrence of predetermined electrical conditions, the armature 611 is pivoted to the position shown in FIG. 22, and the toggle assembly 676 unlatches, whereupon the toggle assembly 676 collapses to the momentary position shown in FIG. 22. At such time the extension 646 forcefully engages the finger 643 and causes the actuator 613 to pivot counterclockwise out of engagement with the button 635, releasing the latter which then rises to the position shown in FIG. 22, the button 635 leaving the recess or detent formed in the lower surace of the actuator 613, as shown. When the button 635 is raised to the position shown in FIG. 22, the internal contacts of the auxiliary switch 630 are closed. The actuator 613 remains in the position shown in FIG. 22, but the toggle assembly 676 and the handle 688 pivot to the position shown in FIG. 23, i.e., the toggle assembly 676 relatches automatically and the handle link 684 moves to the off or contacts open position.

In the position of FIG. 23, the internal contacts of the auxiliary switch 630 are closed, so that the circuit to the trip alarm (not shown) or other device connected to the terminals of the auxiliary switch is energized. To deenergize the trip alarm, i.e., to open the internal contacts of the auxiliary switch, the handle 688 is rotated to the contacts closed position, the position shown in FIG. 20. In so doing, the pin 673 engages the finger 670 and rotates the latter clockwise, the actuator 613 then depressing the button 635 until the latter seats in the recess or detent, the position shown in FIG. 20, opening the internal contacts of the auxiliary switch and, thereby, opening the alarm circuit. To effect the opening of the auxiliary switch contacts it is only necessary to move the movable arm 636 so that its movable contact 634 makes only momentary (or almost makes) contact with the stationary contact 638. (Under some conditions or with some loads, it is permissible to so momentarily close the circuit breaker contacts, but if not, then the embodiment of FIGS. 1 through 15 is preferred.) During the momentary contact of the contacts 634 and 638, the actuator 613 latches upon the button 635 at the detent and the upard bias on the button 635 together with the fact that it is aligned with the pin 662, keeps the actuator 613 in the position of FIG. 20, even though the movable arm 636 returns to the off position of FIG. 21.

If desired, a handle stop, similar to the handle stop 100 described in connection with the embodiment of FIGS. 1 to 16, may be added to the embodiments of FIGS. 17 to 23 in which event the handle will be restrained in an intermediate position while to provide a visual indication of the electrically tripped condition while the auxiliary switch provides an electrical signal.

From the foregoing it is seen that the actuator 130 and auxiliary switch 30 arrangement of the embodiment of FIGS. 1 to 15 requires a handle stop means, such as the handle stop 100, to restrain the actuator 130 in engagement with the button 136 of the auxiliary switch 30 so as to close the internal contacts of the latter to provide an electrical signal indicating the electrically tripped position of the circuit breaker contacts 34 and 38. In the actuator — auxiliary switch embodiments of FIGS. 16 to 23, the arrangement is such that the auxiliary switches 530 or 630 continue to signal the electrical tripped condition of the circuit breaker contacts, even though the handle has moved directly to the off position, i.e., the handle stop means restraining the handle has been omitted. Of course, if desired, a handle stop restraining the handle in an intermediate or tripped position may be added to the embodiments of FIGS. 16 to 23. If the handle stop 100 is omitted from the embodiment of FIGS. 1 to 15, only a momentary closing of the auxiliary switch 30 will take place, and if the circuit connected to the auxiliary switch terminals, is constructed to be actuated by this momentary closing, it may be sufficient.

In the embodiment of FIGS. 1 to 15, the auxiliary switch contacts are opened when the handle is moved from the central or tripped position to its off position, i.e., the alarm may be turned off without reclosing the circuit breaker contacts. In the two embodiments of FIGS. 16 to 23 it is necessary to turn the handle to the on position and to move the movable contact of the circuit breaker to or toward the contacts closed position in order to reset the actuators.

In all three embodiments, the actuators float freely about the pin on which they are mounted. This pin is the same about which the movable contact arm pivots. In all three embodiments, the actuators are located between the frame plates of the circuit breaker. In all three embodiments, rotation of the actuator is limited by another pin carried by the movable contact arm, this pin being the same pin which limits the opening movement of the movable contact arm. Further, this second pin may reset the actuator of FIGS. 1 to 15 and does reset the actuators of FIGS. 16 to 23.

In all three embodiments, this second pin pivots back and forth between two fingers of the actuator without engaging either one during (manual) opening and closing of the circuit breaker contacts.

Further, in all three embodiments the actuators are engaged by an extension of the U-link of the toggle assembly as the toggle collapses after it is tripped.

Also, in all three embodiments the auxiliary switch is fully enclosed within the circuit breaker, although, if desired, the terminals of the auxiliary switch could extend through the base plate.

While not illustrated, it is seen that the stop means provided by the pin 73 in the embodiment of FIGS. 1 to 15 could be formed by projections extending inwardly, for example, from one of the half-cases.

Further, while the actuators have been illustrated and described as supported between the frame plates, it will be seen that they could be supported otherwise within the circuit breaker.

Also, while the handle stop has been illustrated and described as supported on the handle and armature pins, it is seen that handle stop means secured directly to one or the other or both of the half-cases may be utilized.

While not specifically mentioned, it is understood that the two half-cases are secured together by rivets or other suitable fasteners extending through suitable holes in the half-cases.

It will be noted that the overall shape of the actuators of FIG. 1 to 15 and of the embodiment illustrated in FIGS. 16 to 19 is approximately the same because in both embodiments the internal contacts of the auxiliary switches are closed when the buttons are depressed. However, in the embodiment of FIGS. 20 to 23, the internal contacts of the auxiliary switch 630 are closed when the button 635 rises, see FIG. 22. Thus, the left hand side of the actuator 613 must be relieved so as to provide a space, FIG. 22, into which the button 635 may freely move at such time.

If desired a panel 700, FIG. 2, may be placed over the front of the circuit breaker.

Having described this invention, what I claim is:

1. A circuit breaker comprising a case, stationary and movable contacts within said case, a movable contact arm carrying the movable contact, linkage means for moving said movable arm between open and closed contacts positions, operating means connected to said linkage means for moving said linkage means, electromagnetic means for tripping open the contacts on predetermined electrical conditions, stop means for holding said operating means in a position intermediate its contacts open and closed positions subsequent to electrical tripping of the contacts to provide a visual indication of the tripped condition, and switch means responsive only to the electrical tripping of the contacts to provide an electrical signal indicating the tripped condition of the contacts simultaneously with said visual indication.

2. The combination recited in claim 1 wherein said linkage means is of the automatically resettable type.

3. A circuit breaker comprising a case, stationary and movable contacts within said case, a movable arm carrying the movable contact, a frame within said case comprising two spaced frame plates, collapsible linkage means connected to said movable arm, an electromagnetic device for collapsing the linkage means, an actuator engageable by the collapsing linkage means, said actuator and movable arm being pivotally mounted on said frame about a common axis, and switch means engageable by said actuator.

4. The combination recited in claim 3 and further including a pin carried by said movable arm for resetting said actuator.

5. A circuit breaker comprising a load terminal and two line terminals, a case enclosing relatively movable contacts, an electromagnetic device for opening said contacts, said electromagnetic device being connected on one side to said load terminal and on the other side to one of said line terminals, a switch device including a switch module connected to said load terminal and also connected to said electromagnetic device on one side and on the other side to one of said line terminals so as to be in parallel with said electromagnetic device and said relatively movable contacts, said case comprises approximately two half-cases with extending walls, and said switch device being received between said extending walls, whereby a circuit path is provided to said load by said switch device in parallel with said electromagnetic device and said movable contacts.

6. A circuit breaker comprising a case, stationary and movable contacts within said case, an operator, a movable arm carrying the movable contact, a collapsible and automatically resettable linkage means connected between said operator and said movable arm, an electromagnetic device for collapsing linkage means, an actuator engageable by the collapsing linkage means, switch and reset means engageable by said actuator to electrically indicate the collapsed condition of said linkage and thereafter resetting said actuator.

7. The combination recited in claim 6 and further including stop means for limiting movement of said operator intermediate the contacts closed and opened positions of said operator and to retain said linkage in the collapsed condition of said linkage until said operator overrides said stop means, whereupon said actuator is then reset by said switch and reset means.

* * * * *